United States Patent [19]

Reiser et al.

[11] Patent Number: 4,828,488

[45] Date of Patent: May 9, 1989

[54] HEATER PLUG COOLED BY THE COMBUSTION AIR FOR HEATING APPLIANCES

[75] Inventors: Peter Reiser, Esslingen; Fritz Mohring, Ostfildern, both of Fed. Rep. of Germany

[73] Assignee: J. Eberspaecher, Fed. Rep. of Germany

[21] Appl. No.: 175,929

[22] Filed: Mar. 18, 1988

[30] Foreign Application Priority Data

Mar. 18, 1987 [DE] Fed. Rep. of Germany ..... 3708745

[51] Int. Cl.[4] ..... F23Q 7/06

[52] U.S. Cl. ..... 431/263

[58] Field of Search ..... 431/263, 258, 239, 243, 431/246, 242, 160; 237/12.3 L

[56] References Cited

U.S. PATENT DOCUMENTS 2,493,743 1/1950 Benson ..... 431/263 X
2,966,942 1/1961 Breese et al. ..... 431/263 X
2,967,224 1/1961 Irwin ..... 431/263 X
3,852,024 12/1974 Carlsson ..... 431/263 X
4,669,974 6/1987 Sawada et al. ..... 431/263 X

FOREIGN PATENT DOCUMENTS 192506 3/1964 Sweden ..... 431/263

*Primary Examiner*—Randall L. Green
*Attorney, Agent, or Firm*—McGlew & Tuttle

[57] ABSTRACT

A heater plug is cooled with combustion air for diesel oil-burning heating appliances, especially those provided with a vaporizing burner. The plug is screwed into a burner pipe joint, enclosing but spaced inwardly of the plug. The pipe joint also has inlet for supplying the fuel, and it is fastened to the furnace wall of the heating appliances. The burner carries a continuous lengthwise bore, accessible from one end face and opening into the heater plug coil, the inner end of the bore being connected to the combustion air channel across a proportioning throttle.

6 Claims, 2 Drawing Sheets

HEATER PLUG COOLED BY THE COMBUSTION AIR FOR HEATING APPLIANCES

BACKGROUND OF THE INVENTION

Field of the Invention

This invention relates, in general, to combustion heating appliances having a heater plug and, in particular, to a new and useful heater plug for heating appliances which has a furnace with a wall having a cooling air passage which is connectable to a combustion air inlet for the heater plug through a throttling device.

The invention concerns a heater plug, cooled with combustion air, for diesel oil-operated heating appliances, especially such as are provided with a vaporizing burner; the heater plug is screwed into a burner pipe joint, enclosing it at distance, which supplies the fuel and is secured to the furnace wall of the heating appliance.

In such heater plugs, when using low quality, i.e., late boiling fuels, or when the combustion air is polluted by a dustladen environment, or when the coke deposit is improperly stripped off during the previous changing of the plug, the plug aeration channel may be gradually worn down at especially vulnerable locations. This impairs the cooling action. The plug becomes too hot and is prematurely consumed.

SUMMARY OF THE INVENTION

The invention provides a plug layout in which the aeration channel can be easily cleaned. This purpose is achieved by the fact that a burner pipe joint has a continuous lengthwise bore, accessible from one end face and opening into the heater plug coil, the inner end of the bore being connected to the combustion air channel across a proportioning throttle.

In one configuration, the burner pipe joint is firmly joined to the furnace wall and the outer end of the lengthwise bore is detachable from the outside and can be tightly closed, e.g., by a screw. The aeration channel, therefore, can be cleaned out from the outside, once this screw along with the proportioning throttle is removed, without having to take out the plug. this screw can also be provided with an inner projecting pin of such length that it inserts into the throttle and thereby cleans it, by turning the screw.

In a second configuration, the burner pipe joint firmly joined to the furnace wall carries an outer threaded cover, which makes it possible to close the lengthwise bore (to be cleaned from the outside) with a gasket interposed between. It is expedient to have an outwardly retractable filter arranged against the inner circumference of the burner pipe joint, which supplies the mixture of fuel and combustion air to the plug.

In another configuration, the burner pipe joint can be detachably joined to the furnace wall by a threaded sleeve, although this is firmly joined to the wall. Since in this case both the burner pipe joint and the heater plug can be screwed out, the lengthwise bore may be tightly closed and undetachable at the outer end, or even formed as a blind hole in the inner end. The unscrewable burner pipe joint in this case may carry an inwardly retractable plug filter.

Accordingly, it is an object of the invention to provide a heater plug for heating appliances and which have a furnace with wall having a cooling air passage connected to a plug-receiving opening, comprising a tight joint member which has an enclosed heater plug coil and which is secured to the receiving opening with a unit end projecting into the furnace, the pipe joint member having a wall with an inlet for fuel and a longitudinally elongated combustion air inlet passage also defined in the wall at a spaced location from the fuel inlet which has a combustion air inlet lower end connected into the cooling air passage and has an opposite upper end which communicates with the enclosed plug coil and has a throttle defined in the combustion air inlet passage and which also includes closure means for closing the upper end of the combustion air passage.

A further object of the invention is to provide a heater plug for heating appliances in which the regulation of the combustion air is achieved by a closing member for the upper end of the combustion air passage which may be adjusted to influence the throttle or which may constitute a removable closure top or cover.

A further object of the invention is to provide a heater plug for heating appliances which is simple in design, rugged in construction and economical to manufacture.

The various features of novelty which characterize the invention are pointed out with particularity in the claims annexed to the forming a part of this disclosure. For a better understanding of the invention, its operating advantages and specific objects obtained by its uses, reference is made to the accompanying drawings and descriptive matter in which preferred embodiments of the invention are illustrated.

DESCRIPTION OF THE PREFERRED EMBODIMENTS

Figure 1:
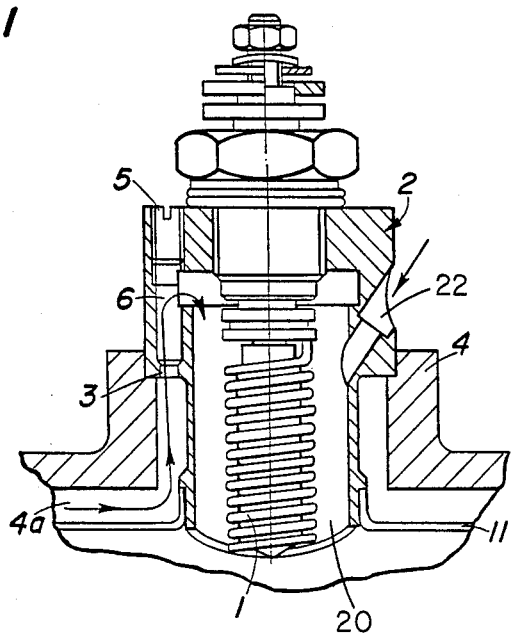
FIG. 1 is an axial sectional view of a plug unit, in which a burner pipe joint is firmly joined to the furnace wall of the heating appliance in accordance with the invention.

Referring to the drawings, in particular, the invention embodied therein, as shown in FIG. 1, comprises a heater plug construction generally designated 1 for heating appliances includes a furnace with a wall 4 which has a combustion air channel 4a which is connected into a plug receiving opening of the furnace. The plug 1 comprises a pipe joint member or connecting piece 2 which is secured in the receiving opening of the furnace and it includes an inner end which projects into the furnace and an outer end. The pipe joint member 2 has a wall with an inlet opening 22 connecting into the space 20 containing the plug 1.

Figure 2:
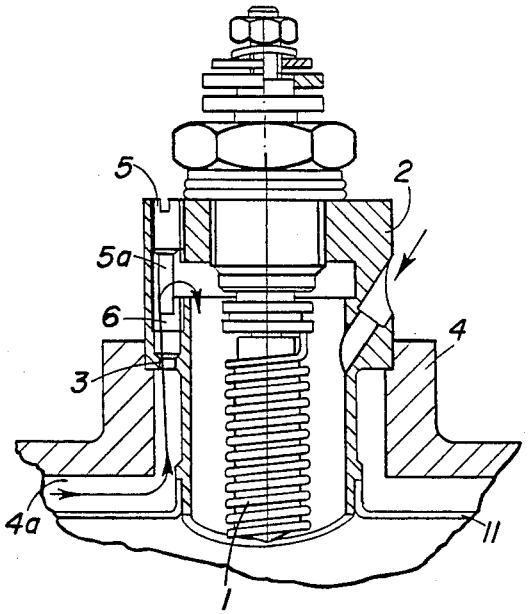
FIG. 2 is a similar view to FIG. 1, but with a different outer closure of the lengthwise bore.
Figure 3:
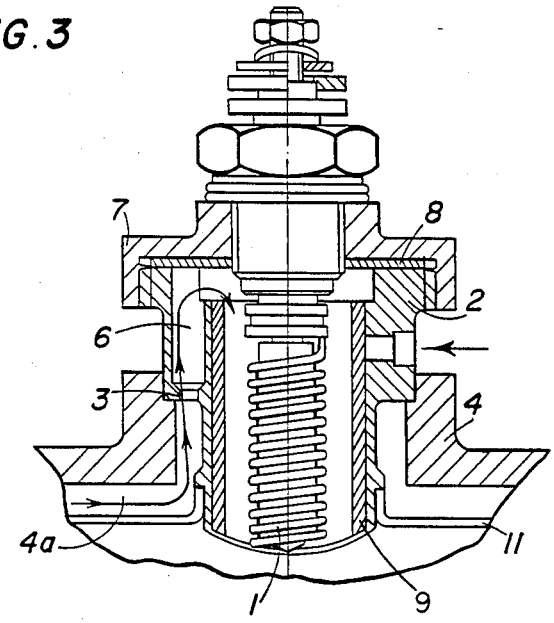
FIG. 3 is a similar view to FIG. 1, but with a threaded cover.

In accordance with the invention, a longitudinally extending combustion air inlet passage or lengthwise bore 6 is also defined in the wall, at a spaced location from the fuel inlet 22. The combustion air inlet passage or lengthwise bore 6 has a lower end connected into the air channel 4a and it has an opposite upper end communicating with the enclosure space 20 containing the coil of the plug 1. A proportioning throttle or restricted portion 3 is defined in the cooling air passage 6. Closure means in the form of a screw 5, as shown in FIG. 1 closes off the top end of the passage 6 and it may have an extension 5a as indicated in FIG. 2. The extension 5a influences the restricting action of the throttle 3. The closure means may also be a closure member 7 as indicated in the embodiment of FIG. 3, or it may be formed entirely in the pipe joint member. The pipe joint member may be threaded into the furnace wall 4 and carry at its lower end the proportioning portion 3 as in the other embodiments.

According to FIG. 1, a burner pipe joint or connecting piece 2 supplying the fuel and enclosing a screwed-in plug 1 with heating coil 1 at a distance is welded at its inner end to a wall of the furnance 11, bordering the combustion air passage or channel 4a. The pipe joint has an outer thicker end which is tightly fitted into an outer wall 4 of the furnace housing. the pipe joint carries a continuous lengthwise or longitudinally extending bore 6, opening into a space 20 having the heater plug coil, the outer end of which at the end face of the burner joint is detachable closed by a screw 5 and the inner end of which is connected to the combustion air channel **4*a* across a proportioning throttle 3**.

According to FIG. 2, the screw 5 carries a projecting pin of such length that it penetrates into the throttle by turning the screw.

According to FIG. 3, the otherwise identical burner pipe joint 2 carries an outer threaded cover 7 with a gasket 8, whereby an access to the lengthwise bore 6 from without is provided. Arranged on the inner circumference of the burner pipe joint is an outwardly retractable plug filter 9, which delivers the mixture of fuel and oppositely streaming combustion air.

Figure 4:
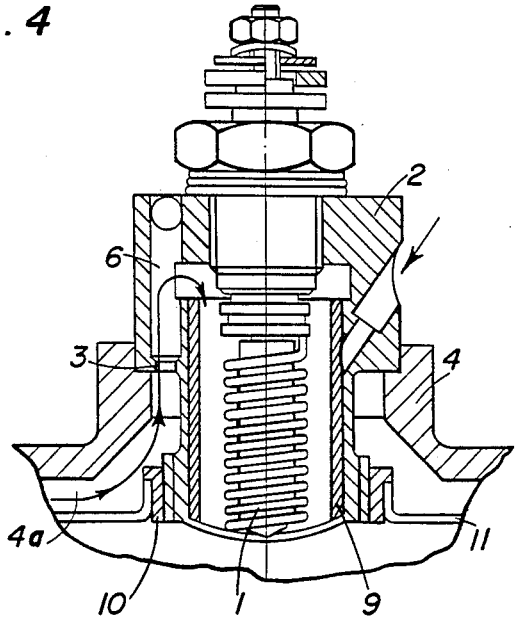
FIG. 4 is a sectional view of a plug unit of another embodiment in which the burner pipe joint is detachably connected to the furnace wall.

According to FIG. 4, the furnace wall 11 bordering the combustion air channel **4*a* is welded together with a threaded sleeve 10, into which the inner end of the burner pipe joint 2 is threaded. The outer thicker end of the pipe joint 2 is tightly but detachably inserted into the wall of the outer furnace housing wall 4. The lengthwise bore 6 with proportioning throttle 3 is tightly and undetachably closed at the outer end in this case. The plug filter 9** can also be installed in the burner pipe joint here.

While specific embodiments of the invention have been shown and described in detail to illustrate the application of the principles of the invention, it will be understood that the invention may be embodied otherwise without departing from such principles.

What is claimed is:

1. A heater plug construction for heating appliances comprising a furnace with a wall defining a combustion air channel connected to a plug receiving opening; a pipe joint member having an enclosed heater plug coil, said pipe joint member being secured in the plug receiving opening with an inner end projecting into the furnace and an outer end exterior of the furnace, said pipe joint member having a wall with an inlet for combustion fuel; a longitudinally extending bore defined in said pipe joint member wall at a spaced location from said fuel inlet, said longitudinally extending bore having a combustion air inlet lower end connected into said combustion air channel and having an opposite upper end extending to said pipe joint outer end communicating with the exterior of the furnace, said longitudinally extending bore communicating with the enclosed plug coil at a location between said lower end and said upper end; a proportioning throttle defined in said longitudinally extending bore adjacent said combustion air channel; and, closure means for closing the upper end of said longitudinally extending bore.

2. A heater plug construction according to claim 1, wherein the longitudinally extending bore is accessible from one end face of said pipe joint adjacent said outer end, said pipe joint member being joined to said furnace wall, said closure means comprising a cover which may be tightly closed and detached from outside of the upper end of said longitudinally extending bore.

3. A heater plug construction according to claim 2, wherein the closure means for closing the upper end of said longitudinally extending bore comprises a screw threaded into said passage.

4. A heater plug construction according to claim 3, wherein said screw has an inner projecting pin of a length that penetrates into said throttle when said screw is threaded into the upper end of said longitudinally extending bore.

5. A heater plug construction according to claim 2, wherein said closure means includes a threaded cover member covering said pipe joint member outer end and including a gasket between said cover member and said pipe joint member.

6. A heater plug construction according to claim 1, wherein said burner pipe joint member is detachably connected to said furnace wall by a threaded sleeve.

* * * * *